US005083783A

United States Patent [19]

Viveiros

[11] Patent Number: 5,083,783

[45] Date of Patent: Jan. 28, 1992

[54] POSTER GAME APPARATUS

[76] Inventor: Donna M. Viveiros, 25 Gentle Valley Dr., N. Dartmouth, Mass. 02747

[21] Appl. No.: 642,860

[22] Filed: Jan. 14, 1991

[51] Int. Cl.[5] ..... A63F 9/00

[52] U.S. Cl. ..... 273/138 R; 273/282; 273/459

[58] Field of Search ..... 273/459, 347, 282, 138 R

[56] References Cited

U.S. PATENT DOCUMENTS 737,207 8/1903 Chaboty ..... 273/459 X
1,090,653 3/1914 Rothstein ..... 273/459 X

FOREIGN PATENT DOCUMENTS 455557 10/1936 United Kingdom ..... 273/347

*Primary Examiner*—Paul E. Shapiro
*Attorney, Agent, or Firm*—Leon Gilden

[57] ABSTRACT

An apparatus mounted on a unitary support blank arranged to effect a game scenario for ease of transport and storage, wherein the apparatus includes a planar support base formed of a rigid material including a furled poster mounted essentially coextensively adjacent a first edge of the support base, with the support base further including a blindfold member, a scorekeeping member, and a wax stick, each adhesively mounted to the support base on an upper surface thereof. The support base further includes a matrix of token members, wherein the token members are each defined by a continuous perforated perimeter edge to permit ease of removal of each token member relative to the support base. The poster member is removed from the support base in use and mounted, whereupon each individual player of a plurality of players is blindfolded and the player attempts to position a token member relative to the unfurled poster member relative to a target object thereon.

5 Claims, 3 Drawing Sheets

PRIOR ART

POSTER GAME APPARATUS

BACKGROUND OF THE INVENTION

1. Field of the Invention

The field of invention relates to game apparatus, and more particularly pertains to a new and improved poster game apparatus wherein the same is conveniently arranged for mounting of various components of a game organization.

2. Description of the Prior Art

Games of various types have been provided in the prior art for amusement of individuals thereof. In various ceremonial and party type gatherings, various party "favors" are distributed, and the party "favors" provide relative enjoyment to individuals where their ease of transport and storage by individuals prior to and subsequent distribution is essential in their distribution and use Various game apparatus has been provided in the prior art to include poster-like scenarios, such as exemplified in U.S. Pat. No. 3,866,919 wherein a game board includes a plurality of playing fields in the form of circular recesses formed on the game board.

U.S. Pat. No. 4,185,833 to McKee sets forth a game apparatus including a code card and card holder and matrix sheet provided with various information for interplay of the various components.

U.S. Pat. No. 3,905,602 to Madonn, Jr., et al. sets forth a board game defined by a playing surface including apertures therethrough, with various peg members mounted within the apertures relative to predetermined rules defined by the game apparatus.

U.S. Pat. No. 4,182,516 to Gill sets forth a racing simulation game utilizing a game board with a matrix of apertures directed thereabout for simulating movement of a sail boat type token.

As such, it may be appreciated that there continues to be a need for a new and improved poster game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides a poster game apparatus wherein the same includes a unitary support base removably mounting various components of a game, with the base further including a scoring indicating surface mounted thereon for use in containing relative scoring totals by individuals in participation of the game. As such, the general purpose of the present invention, which will be described subsequently in greater detail, is to provide a new and improved poster game apparatus Which has all the advantages of the prior art game apparatus and none of the disadvantages.

To attain this, the present invention provides an apparatus mounted on a unitary support blank arranged to effect a game scenario for ease of transport and storage, wherein the apparatus includes a planar support base formed of a rigid material including a furled poster mounted essentially coextensively adjacent a first edge of the support base, with the support base further including a blindfold member, a scorekeeping member, and a wax stick, each adhesively mounted to the support base on an upper surface thereof. The support base further includes a matrix of token members, wherein the token members are each defined by a continuous perforated perimeter edge to permit ease of removal of each token member relative to the support base. The poster member is removed from the support base in use and mounted, whereupon each individual player of a plurality of players is blindfolded and the player attempts to position a token member relative to the unfurled poster member relative to a target object thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved poster game apparatus which has all the advantages of the prior art game apparatus and none of the disadvantages.

It is another object of the present invention to provide a new and improved poster game apparatus which may be easily and efficiently manufactured and marketed.

It is a further object of the present invention to provide a new and improved poster game apparatus which is of a durable and reliable construction.

An even further object of the present invention is to provide a new and improved poster game apparatus which is susceptible of a low cost of manufacture with regard to both materials and labor, and which accordingly is then susceptible of low prices of sale to the consuming public, thereby making such poster game apparatus economically available to the buying public.

Still yet another object of the present invention is to provide a new and improved poster game apparatus which provides in the apparatuses and methods of the prior art some of the advantages thereof, while simultaneously overcoming some of the disadvantages normally associated therewith.

Still another object of the present invention is to provide a new and improved poster game apparatus wherein the same includes a unitary support base mounting various components removably therefrom for subsequent play of the game apparatus providing ease of disposal of the organization subsequent to use.

These together With other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
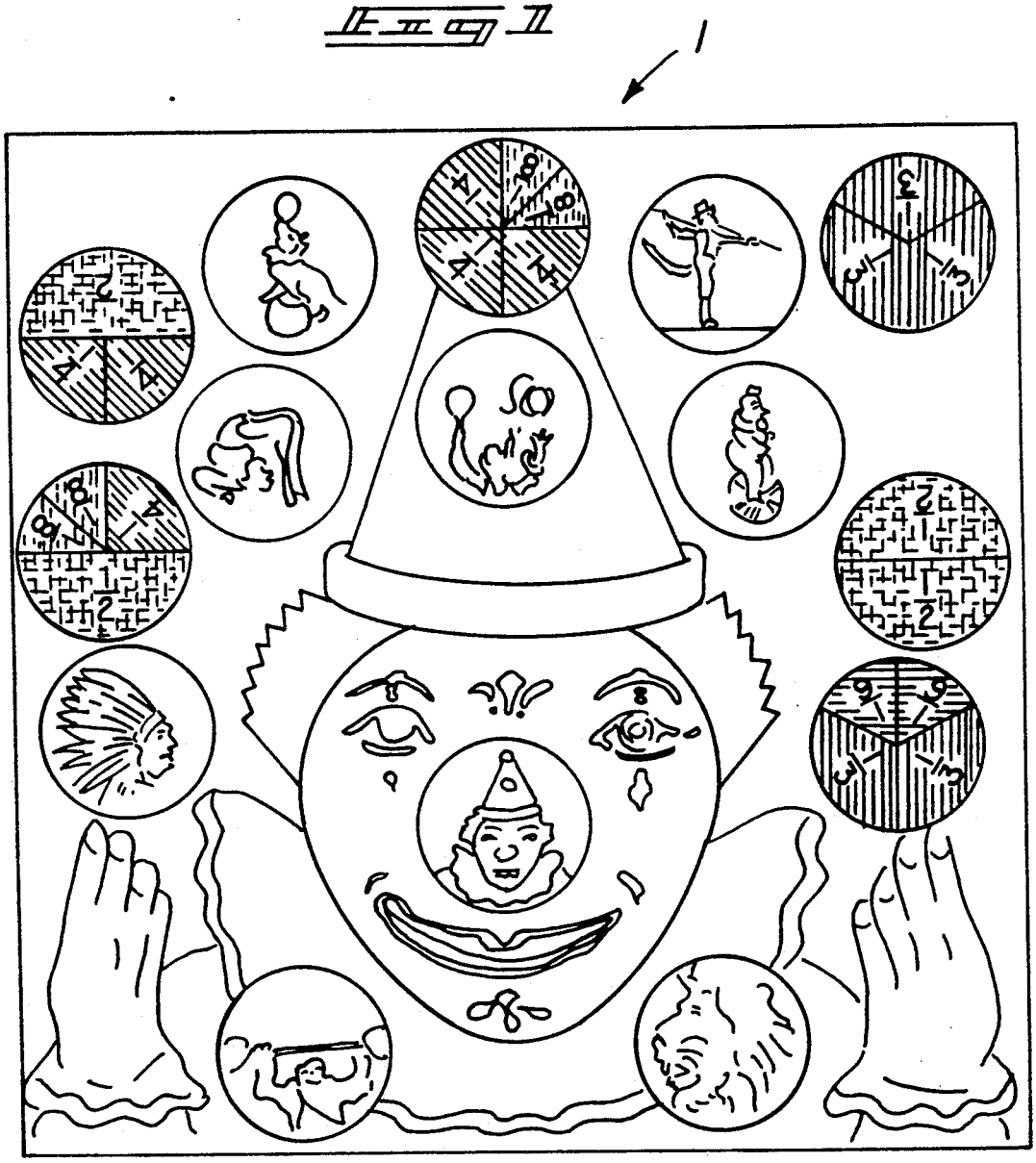
FIG. 1 is an orthographic top view of a prior art game board, including various playing components mounted on the game board.
Figure 2:
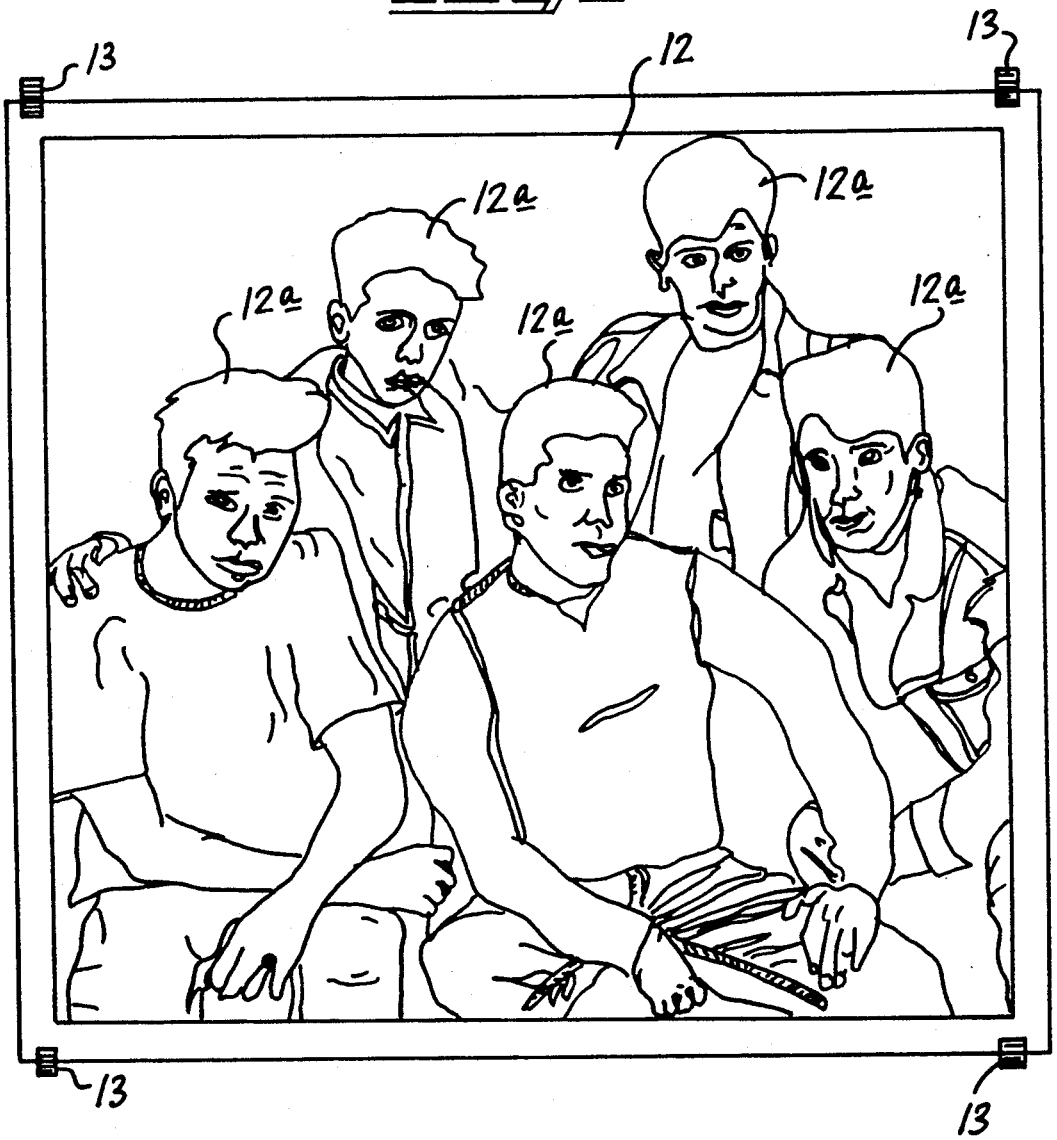
FIG. 2 is an orthographic top view of the poster member utilized by the instant invention in an unfurled planar configuration.
Figure 3:
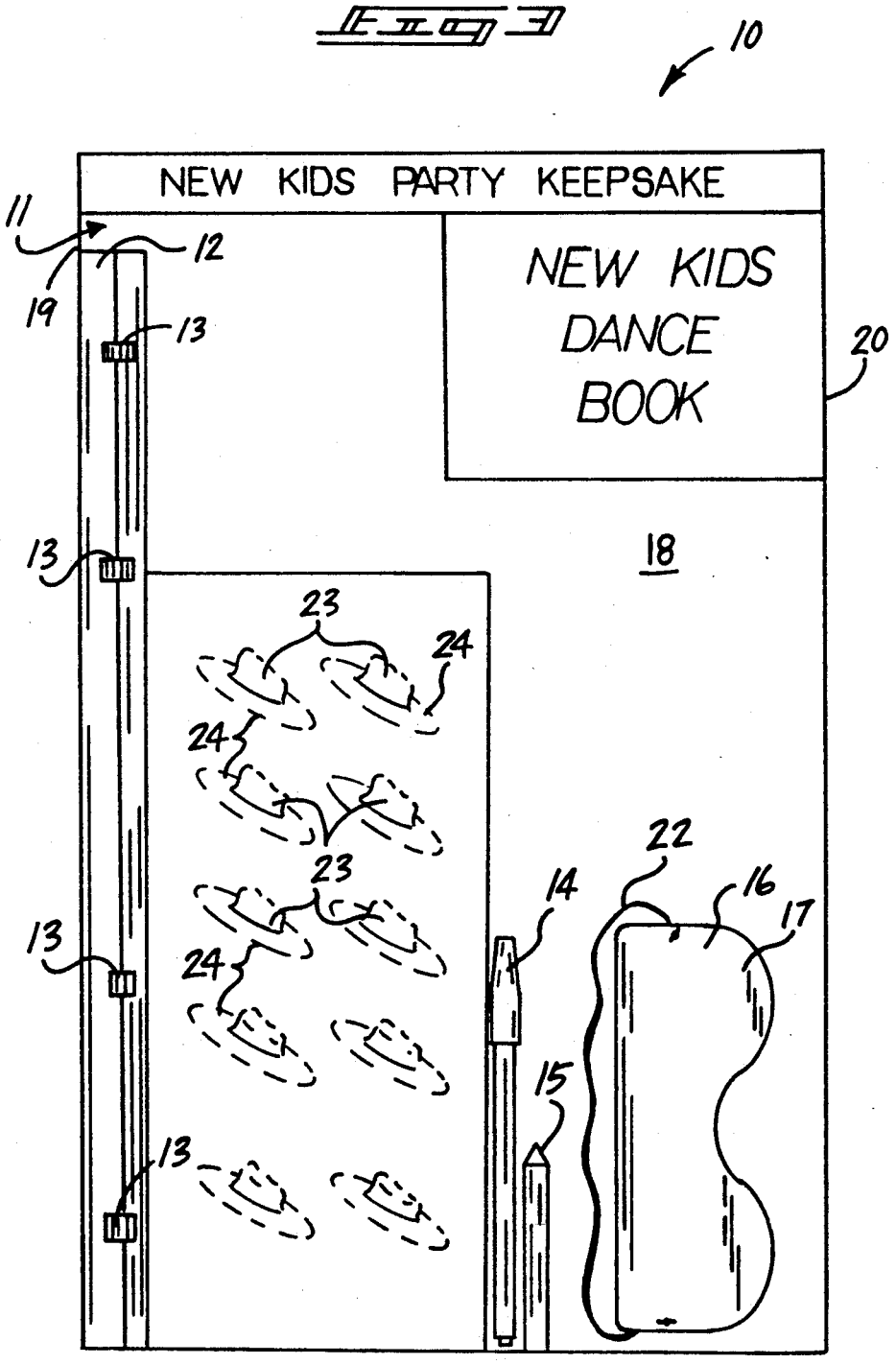
FIG. 3 is an orthographic top view of the poster game apparatus and the various components thereof.

With reference now to the drawings, and in particular to FIGS. 1 to 3 thereof, a new and improved poster game apparatus embodying the principles and concepts of the present invention and generally designated by the reference numeral 10 will be described.

FIG. 1 illustrates a prior art game apparatus 1, wherein the game board includes a plurality of playing fields in the form of circular recesses utilizing various spinners and tokens for directing play about the various playing fields, in a manner as set forth in U.S. Pat. No. 3,866,919.

More specifically, the poster game apparatus 10 of the instant invention essentially comprises a rigid, planar support base 11 formed of a cellar, or selectively of a polymeric material A furled poster 12 is mounted coextensively and adhesively to a top surface of the support base 11 and substantially coextensively along a first elongate side edge thereof. The poster member 12 is removable from the top surface of the support base 11 and opened to an unfolded configuration, as illustrated in FIG. 2, to illustrate a series of target figures therewithin, wherein each target figure includes a target surface 12*a* for use with various tokens of the game apparatus, to be described in more detail below. Removable adhesive strips 13 are mounted to the furled poster 12 when adhesively mounted upon the top surface of the support base 11 to maintain the poster in a furled configuration, whereupon the adhesive strips 13 are removed therefrom and utilized to mount the poster upon a support surface, as illustrated in FIG. 2. At least four such adhesive strips 13 are provided for positioning adjacent each corner, of a generally rectangular first poster 12 when in the unfurled planar configuration, as illustrated in FIG. 2.

The top surface of the support base 11 further includes a score marking writing instrument 14 adhesively mounted thereon, with an adjacent wax pencil stick adhesively mounted to the top surface of the support base 11. Blindfold blank member 16, that includes a continuous blank member perimeter edge 17, is adhesively mounted to the top surface of the support base 11 adjacent the Writing instrument 14 and the wax pencil stick 15 utilizing an adhesive mounted to the perimeter edge 17 to secure the blindfold blank member to the top surface of the support base. An elastomeric band 22 includes opposed terminal ends secured to opposed end edges of the blindfold blank member 16 to permit securement of the blindfold blank member about a player's head to cover the player's eye portions during each sequential turn of each player. A scorekeeping surface 18 is defined on the support base 11 for each individual player to maintain an individual score thereon utilizing the writing instrument 14. Accordingly, the scorekeeping surface 18 is defined between the first and second elongate side edges 19 and 20 A plurality of token members 23 are formed within the support base 11 and are defined by token member continuous perforated perimeter edges 24 defining each token member 23, wherein the perforated perimeter edge 24 of each token member permits ease of removal of each token for use in playing of the game.

In play, a plurality of players arbitrarily determine the sequence of play among the players, wherein each player in turn has the blindfold blank member 16 mounted about the player's head and eyes to prevent individual observation of the poster 12 when in the planar unfurled configuration, as illustrated in FIG. 2, utilizing the adhesive members 13 to mount the poster 12. The wax pencil stick 15 is utilized to form a wax film on a rear surface of each token member 23 when removed from the support base 11. The wax thusly applied to the rear surface of each token member 23 permits adherence of token member 23 on the poster 12. The game's object is for the blindfolded player to approach a preselected target surface 12*a* of a plurality of target surfaces, whereupon a player placing a token member 23 on the poster 12 closest to an associated target surface 12*a* is declared a winner. Such winners are provided a predetermined point total, such as 1 point for positioning a token member 23 proximate the target surface 12*a* and 2 points for positioning of a token member 23 on a predetermined target surface 12*a*. A player with the greatest point total is ultimately declared a winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A poster game apparatus comprising, in combination, a rigid, planar support base, the support base including a planar top surface including a first elongate side edge spaced from a second elongate side edge, and a furled poster mounted to the top surface of the support base, and a score marking writing instrument mounted to the top surface, and a wax pencil stick mounted to the top surface adjacent the score marking writing instrument, and an elongate blindfold blank member mounted to the top surface adjacent the wax pencil stick, and a plurality of token members formed in the support base removably mounted relative to the support base.

2. An apparatus as set forth in claim 1 wherein the token members are each defined by a continuous perforated perimeter edge directed through the support base to permit ease of removal of each token member relative to the support base.

3. An apparatus as set forth in claim 2 wherein the furled poster is adhesively mounted to the top surface substantially coextensive with the first elongate side edge, and the furled poster member including a plurality of adhesive strips to secure the furled poster in a furled configuration, whereupon the adhesive strips are removably mounted relative to the furled poster to permit mounting of the poster in a planar configuration upon a support surface upon removal from the support base.

4. An apparatus as set forth in claim 3 wherein the writing instrument, the wax pencil stick, and the elongate blindfold blank member are each adhesively mounted to the top surface of the support base, and the blindfold blank member includes a blank member perimeter edge wherein the perimeter edge only is adhesively mounted to the top surface of the support base, and the blindfold blank member includes an elongate, elastomeric band, wherein the elongate elastomeric band includes opposed ends, wherein each end of the elastomeric band is secured to opposed side edges of the blindfold blank member to permit securement of the blindfold blank member about an individual player.

5. An apparatus as set forth in claim 4 wherein the top surface of the planar support base includes a scorekeeping surface between the first elongate side edge and the second elongate side edge for accepting scoring thereon by the score marking writing instrument.

* * * * *